US010357112B2

(12) United States Patent
Zheng

(10) Patent No.: US 10,357,112 B2
(45) Date of Patent: Jul. 23, 2019

(54) COLLAPSIBLE FLOATING ASSEMBLIES

(71) Applicant: Patent Category Corp., Walnut, CA (US)

(72) Inventor: Yu Zheng, City of Industry, CA (US)

(73) Assignee: Patent Category Corp., Walnut, CA (US)

( * ) Notice: Subject to any disclaimer, the term of this patent is extended or adjusted under 35 U.S.C. 154(b) by 139 days.

(21) Appl. No.: 15/693,777

(22) Filed: Sep. 1, 2017

(65) Prior Publication Data

US 2019/0069680 A1 Mar. 7, 2019

(51) Int. Cl.
*A47C 15/00* (2006.01)
*B63B 35/74* (2006.01)

(52) U.S. Cl.
CPC ..... *A47C 15/006* (2013.01); *B63B 35/74* (2013.01)

(58) Field of Classification Search
CPC ..... A47C 15/006; B63B 35/74; B63B 35/76; B63B 35/78
USPC ..... 441/129–132
See application file for complete search history.

(56) References Cited

U.S. PATENT DOCUMENTS 1,184,325 A * 5/1916 Coxey ..... B63C 9/26 441/80
3,602,930 A * 9/1971 Channon ..... A47C 3/12 441/65
5,226,184 A * 7/1993 Cheng ..... B63B 35/76 441/125
5,483,914 A * 1/1996 Wonka ..... B63B 3/08 114/345
5,628,658 A * 5/1997 Clifford ..... A47C 15/006 441/130
6,881,114 B2 * 4/2005 Zheng ..... B63B 7/08 441/129
7,137,856 B2 * 11/2006 Zheng ..... A47C 15/006 441/129
7,207,857 B2 4/2007 Zheng
8,657,640 B2 * 2/2014 Le Gette ..... A47C 15/006 441/131
9,849,949 B2 * 12/2017 Arias ..... B63B 7/08

* cited by examiner

*Primary Examiner* — Ajay Vasudeva
(74) *Attorney, Agent, or Firm* — Raymond Sun

(57) ABSTRACT

A floating assembly for suspending a person on water has a foldable frame member that has a folded and an unfolded orientation, the frame member defining a periphery for the assembly. A sheet material covers portions of the frame member when the frame member is in the unfolded orientation. A plurality of floatation sleeves are attached to the periphery. A plurality of floatation devices are removably inserted into each of the floatation sleeves.

6 Claims, 13 Drawing Sheets

32a
20a
30a
26
28
24
38
30

COLLAPSIBLE FLOATING ASSEMBLIES

BACKGROUND OF THE INVENTION

1. Field of the Invention

The present invention relates to collapsible structures, and in particular, to collapsible floating panels, structures and assemblies which offer multiple uses, and which may be twisted and folded to reduce the overall size of the assembly to facilitate convenient storage and use.

2. Description of the Prior Art

Collapsible objects have recently become popular with both adults and children. Examples of such collapsible objects are shown and described in U.S. Pat. Nos. 5,038,812 (Norman), 5,467,794 (Zheng) and 5,560,385 (Zheng) in the form of collapsible structures. These structures can be used as play structures, shelters, tents, and storage structures, among other uses. These structures may be twisted and folded to reduce the overall size of the structures to facilitate convenient storage and use. As such, these structures are being enjoyed by many people in many different applications.

Other examples of collapsible objects include blanket, mat and floating assemblies as illustrated in one or more of U.S. Pat. Nos. 6,073,283 (Zheng), 6,170,100 (Le Gette et al.), 6,343,391 (Le Gette et al.) and 6,908,353 (Zheng). These assemblies can be used as blankets, floor mats, and floating mats. These blankets and mats may be twisted and folded to reduce the overall size of the blanket or mat to facilitate convenient storage and use.

In particular, floating assemblies have become increasingly popular as they allow users to lounge in the water of a swimming pool. Conventional floating assemblies are often called "floating islands", and are essentially inflatable pool loungers that need to be inflated for use, and deflated for storage. Since it can be time-consuming to inflate and deflate large floating assemblies, there is a need for floating assemblies that can be easily and quickly deployed and packed up.

In addition, many of the currently-available floating islands and floating assemblies come in a pre-set configuration or size, and the user often desires to have more flexibility to change the configurations and/or sizes of the assemblies to suit different needs.

Thus, there remains a need for floating assemblies that can be easily and quickly deployed and packed up, and which allow the user to change the configurations and/or sizes to suit different needs.

SUMMARY OF THE DISCLOSURE

In order to accomplish the objects of the present invention, one embodiment provides a floating assembly for suspending a person on water, the floating assembly having a foldable frame member that has a folded and an unfolded orientation, the frame member defining a periphery for the assembly. A sheet material covers portions of the frame member when the frame member is in the unfolded orientation. A plurality of floatation sleeves are attached to the periphery, including a first floatation sleeve. A plurality of floatation devices are removably inserted into each of the floatation sleeves.

In another embodiment, a floating assembly is provided for suspending a person on water, the floating assembly having a foldable frame member that has a folded and an unfolded orientation, the frame member defining a periphery for the assembly. A sheet material covers portions of the frame member when the frame member is in the unfolded orientation, the sheet material defining a plane with a cut-out region. The cut-out region has a base section, a rear section and two side sections, the base section having three side edges, and each rear section and side section having a bottom edge, with the rear section and side sections extending perpendicularly from the plane of the sheet material, and the base section extending at an angle from sheet material in a manner such that side edges of the base section are connected to bottom edges of the rear section and the side sections. A plurality of floatation sleeves are attached to the periphery, and a plurality of floatation devices are removably inserted into each of the floatation sleeves.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
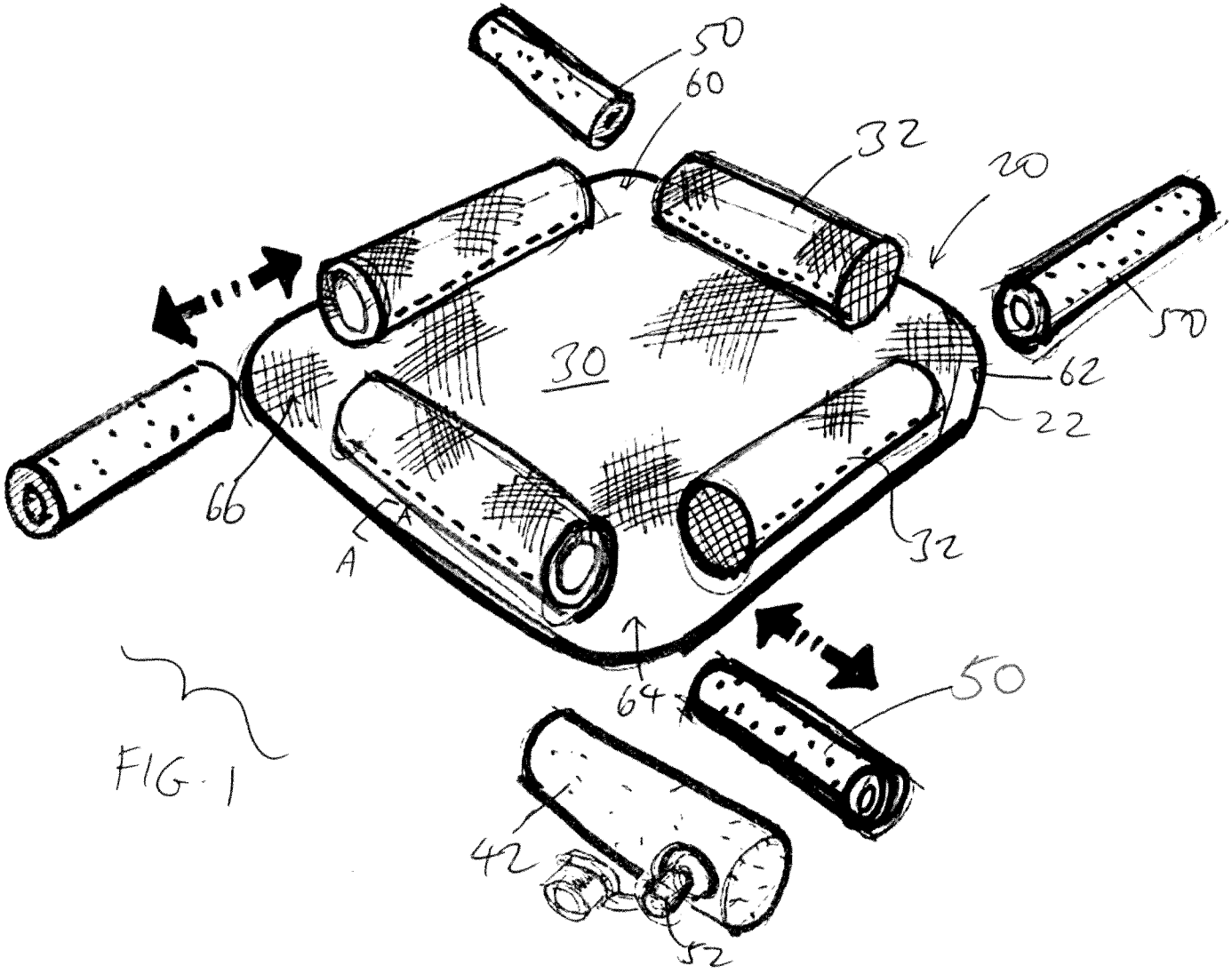
FIG. 1 is a perspective view of a floating assembly according to one embodiment of the present invention shown in use in its expanded configuration.
Figures 2, 4:
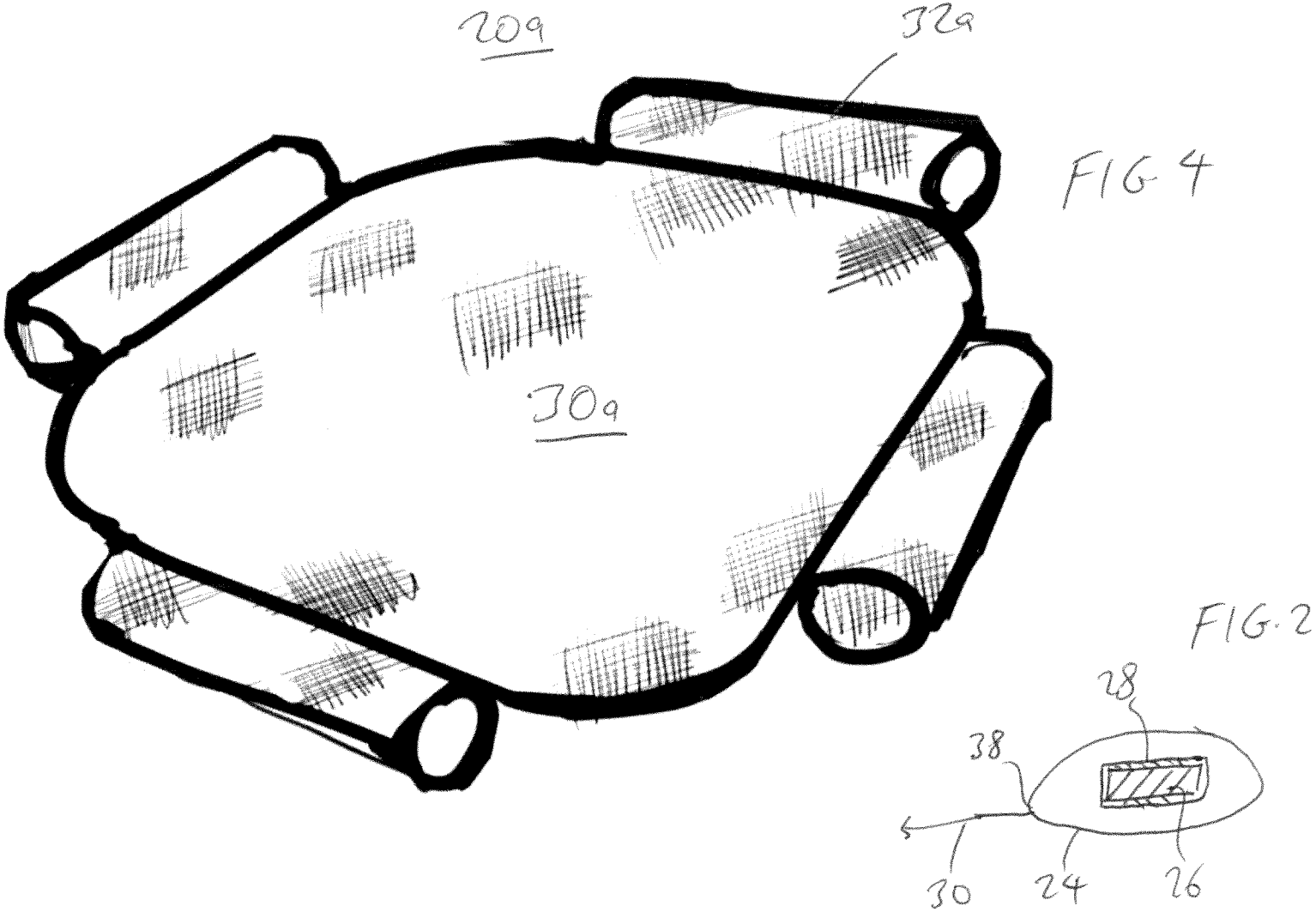
FIG. 2 is a cross-sectional view of the assembly of FIG. 1 taken along line A-A thereof.
FIG. 4 is a perspective of a floating assembly according to another embodiment of the present invention.

Referring to FIGS. 1 and 2, the present invention provides a floating assembly 20 that can assume any configuration, such as circular, oval, or rectangular, square, trapezoidal, or irregular. The assembly 20 has a peripheral edge 22 that extends all the way around the assembly 20. A peripheral frame retaining sleeve 24 is provided along and traverses the peripheral edge 22, and a frame member 26 is retained or held within the frame retaining sleeve 24 such that the frame member 24 extends completely around the peripheral edge 22.

The frame member 26 may be provided as one continuous loop, or may be a strip of material connected at both ends to form a continuous loop, or can be a strip of material having opposite ends that are adjacent to (but not connected to) each other. The frame member 26 is preferably formed of flexible coilable steel, although other materials such as plastics may also be used. The frame member 26 should be made of a material which is relatively strong and yet is flexible to a sufficient degree to allow it to be coiled. Thus, the frame member 26 is capable of assuming two positions, an open or expanded position such as shown in FIG. 1, or a folded position (see FIG. 3D) in which the frame member is collapsed into a size which is much smaller than its open position. The frame member 26 may be merely retained within the frame retaining sleeve 24 without being connected thereto. Alternatively, the frame retaining sleeve 24 may be mechanically fastened, stitched, fused, or 1C glued to the frame member 26 to retain the frame member 26 in position.

In addition, a protective covering 28 can be provided to cover the frame member 26. The protective covering 28 can be the same as that which is described in U.S. Pat. No. 5,845,697 to Zheng, whose entire disclosure is incorporated by this reference as though set forth fully herein. The protective covering 28 can be effective in preventing the metallic frame member 26 from rust and damage due to its anticipated exposure to water.

Sheet material 30 extends across the interior space defined by the sleeve 24, and is held taut by the frame member 26 when the sheet material 30 is in its open position. The term "sheet material" is to be given its broadest meaning and should be made from strong, flexible yet lightweight materials and may include woven fabrics, sheet fabrics, meshed fabrics or even films. The sheet material 30 can be water-resistant and durable to withstand the wear and tear associated with extended use, and rough treatment by adults and children. The sheet material 30 can also allow water to pass therethrough (e.g., such as a meshed material).

As illustrated best in FIG. 2, the sleeve 24 may attached to the sheet material 30 by a stitching 38. The stitching 38 can also operate to enclose the sleeve 24. Alternatively, the sleeve 24 can be a part of or an extension of the sheet material 30, where the outer edge of the sheet material 30 is wrapped around the frame member 26 to enclose the frame member 26, and then a stitching 38 is applied to enclose the sleeve 24.

A plurality of floatation devices 50 are provided in spaced-apart manner about the peripheral edge 22. Each floatation device 50 can be housed in a separate floatation sleeve 32 that can be stitched or otherwise permanently or removably attached to the sheet material 30. Each floatation sleeve 32 is provided with opposite opened ends so that the floatation device 50 can be easily slipped into and removed from the floatation sleeve 32. The floatation device 50 can be embodied in any desirable structure, including but not limited to one or more foam pieces, or one or more inflatable bags 42, FIGS. 1 and 2 illustrate the use of an inflatable bag 42 which has a hollow interior that is adapted to receive an inflation medium (e.g., air or liquid) via a valved port 52.

Figure 7A:
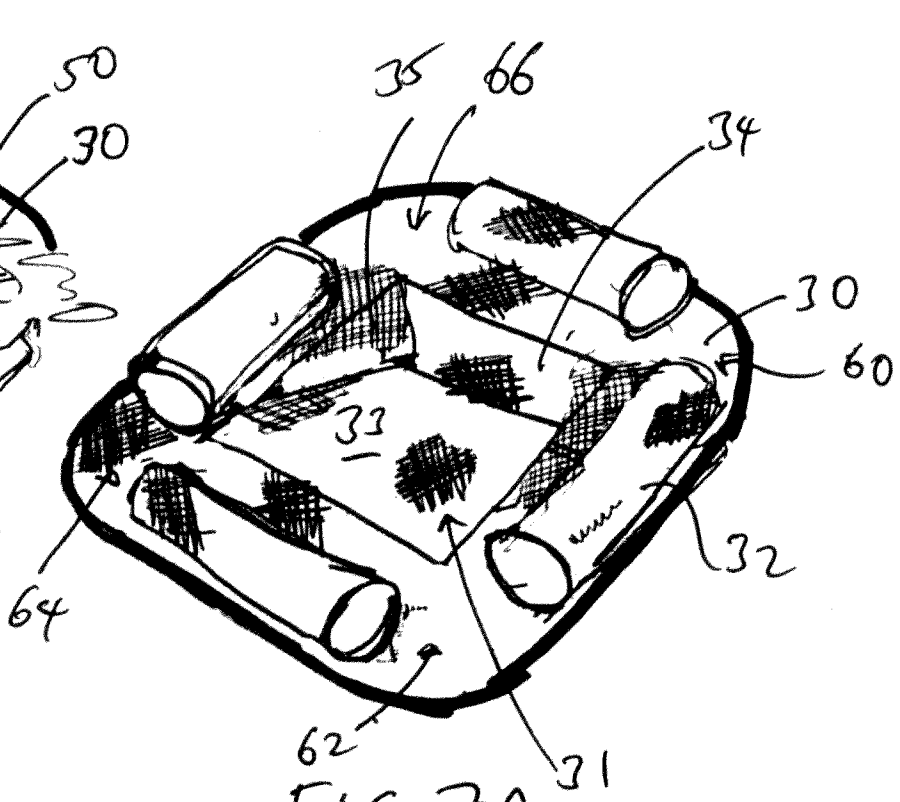
FIG. 7A is a perspective of a floating assembly according to another embodiment of the present invention.
Figure 7B:
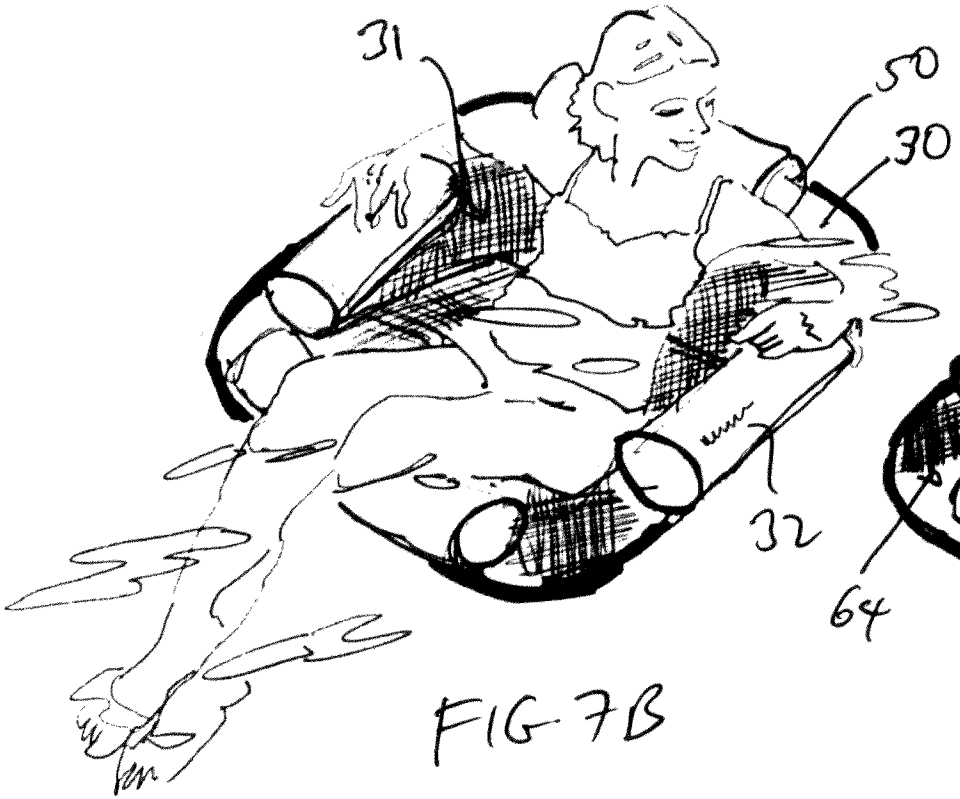
FIG. 7B illustrates a user seated on the floating assembly of FIG. 7A.

The floatation devices 50 can be spaced-apart about the peripheral edge 22 so as to define an open space between each pair of adjacent floatation devices 50. For example, FIGS. 1 and 7A show at least four separate floatation devices 50 that are provided to define four separate open spaces 60, 62, 64 and 66 between each other. Each of these spaces 60, 62, 64, 66 is provided along the peripheral edge 22, and each is adapted to receive part of a human limb when a user is resting or lying on the sheet material 30. For example, as shown in FIG. 7B, when the user lies on the sheet material 30 with the back and neck resting on one floatation device (which can function as a neck pillow), part of each of the user's arms can extend through two of the spaces 60 and 66, and part of each of the user's legs can extend through the other two spaces 62 and 64, or be propped over the a floatation device 50.

In use, the user can inflate the floatation devices 50 and then place the assembly 20 into a body of water (e.g., swimming pool, beach, lake, etc.). The user can then climb on to the top surface of the assembly 20 and then sit, lie or rest on the assembly 20 as the assembly 20 floats on the water, as shown in FIG. 7B.

Figure 3B:
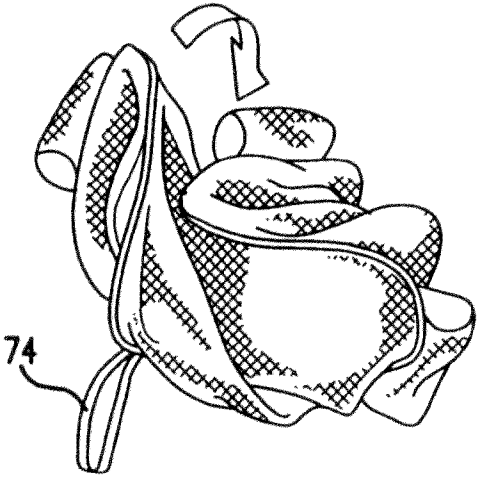
FIGS. 3A-3F illustrate how the assembly of FIG. 1 can be twisted and folded for compact storage.
Figure 3C:
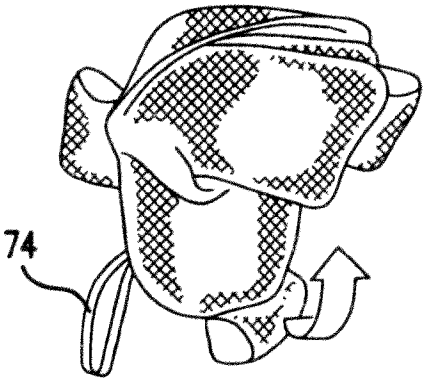
Figure 3A:
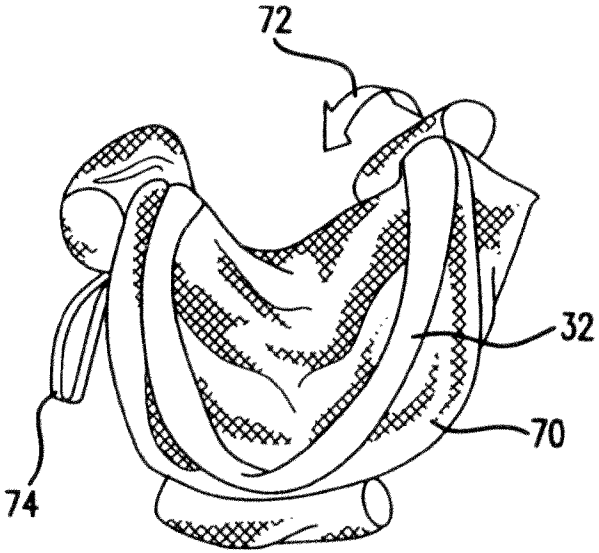
Figure 3E:
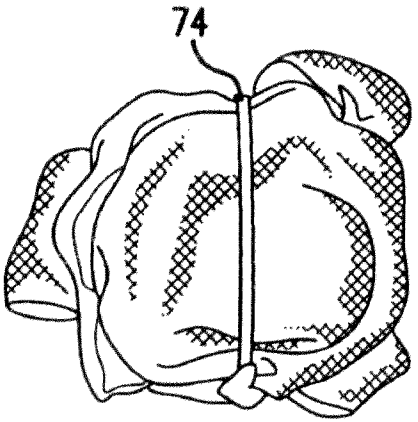

To store the assembly 20, the user first removes the floatation devices 50 from the floatation sleeves 32 so that the entire assembly 20 can have a generally flat profile. The assembly 20 can then be folded and collapsed into a compact configuration for storage, as illustrated in FIGS. 3A-3F. In the first step illustrated in FIG. 3A, the opposite border 70 of the assembly 20 is folded in (see arrow 72) to collapse the frame member 26 with the sheet material 30. As shown in FIG. 3B, the next step is to continue the collapsing so that the initial size of the assembly 20 is reduced. FIG. 3C shows the next step with the frame member 26 and sheet material 30 collapsed on each other to provide for a small essentially compact configuration having a plurality of concentric frame members 26 and layers of the sheet material 30 so that the collapsed assembly 20 has a size which is a fraction of the size of the initial assembly 20, as shown in FIG. 3D.

In addition, a retaining member or strap 74 (shown in FIGS. 3A-3E only) may be attached to the peripheral edge 22. As shown in FIGS. 3D and 3E, the strap 74 may be used to tie or hold the collapsed assembly 20 in the collapsed position. Alternatively, a bag (not shown) may be used to store the collapsed assembly 20.

Figure 3F:
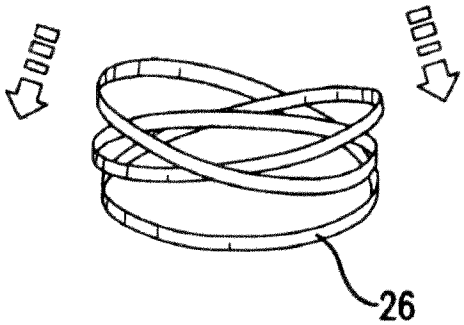
Figure 3D:
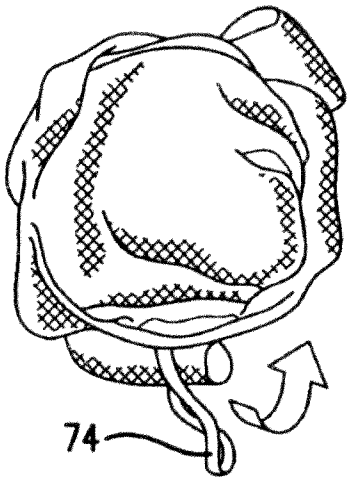

FIG. 3F illustrates the closed loop of the frame member 26 in the collapsed position. The structure of each closed loop essentially consists of two sets of three concentric rings intertwined to lie flat. In the collapsed position, the structure will have a significantly reduced diameter which makes it easy to store the collapsed assembly 20. This reduced size is especially convenient when the assembly 20 is to be used away from the home, such as during travel or at the beach where the assembly 20 can be easily and conveniently packed, stored and transported.

The assembly 20 can be expanded again by opening the coiled frame member 26. The bias and resiliency of the frame member 26 will cause the frame member 26 (and the attached sheet material 30) to automatically open out to the expanded position shown in FIG. 1.

FIG. 4 illustrates another floating assembly 20*a* according to the present invention. The assembly 20*a* is essentially the same as the assembly 20 of FIG. 1, so the same numeral designations will be used for both the assemblies 20 and 20*a*, except that an "a" is added to the designations in FIG. 4. The assembly 20*a* is essentially the same as the assembly 20 of FIG. 1, except that the floatation sleeves 32*a* are stitched directly to the peripheral sleeve 24.

Figure 5:
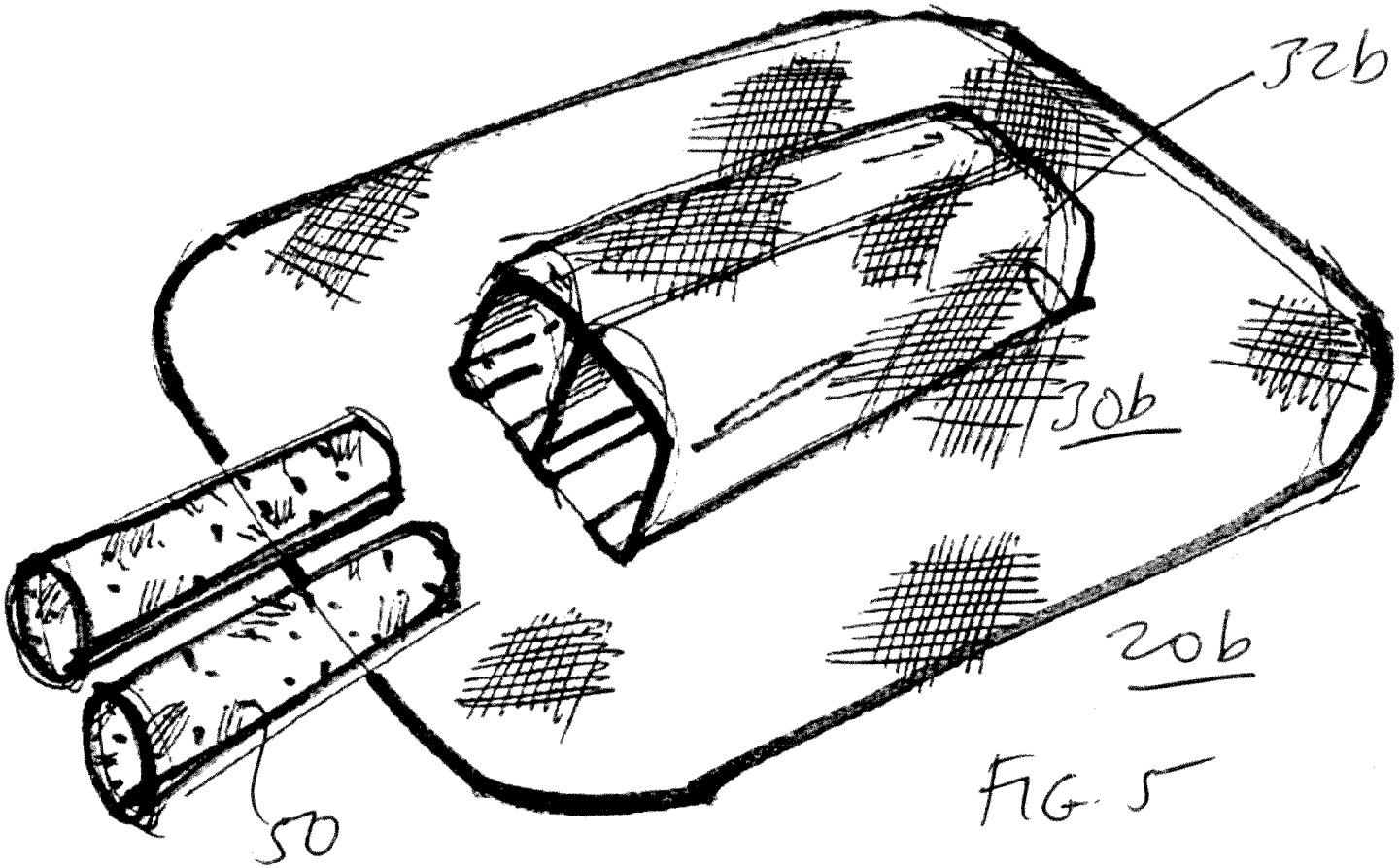
FIG. 5 is a perspective of a floating assembly according to yet another embodiment of the present invention.

FIG. 5 illustrates another floating assembly 20*b* according to the present invention. The assembly 20*b* is essentially the same as the assembly 20 of FIG. 1, so the same numeral designations will be used for both the assemblies 20 and 20*b*, except that a "b" is added to the designations in FIG. 5. The assembly 20*b* is essentially the same as the assembly 20 of FIG. 1, except that the floatation sleeves 32*b* are stitched directly to the sheet material 30*b* at the center of the sheet material 30*b*.

Figure 6B:
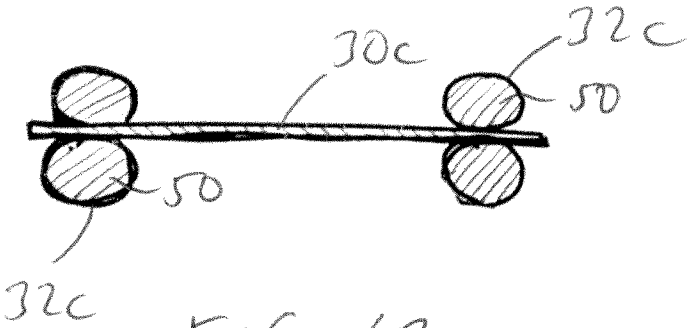
FIG. 6B is a cross-sectional view of the floating assembly of FIG. 6A.
Figure 6A:
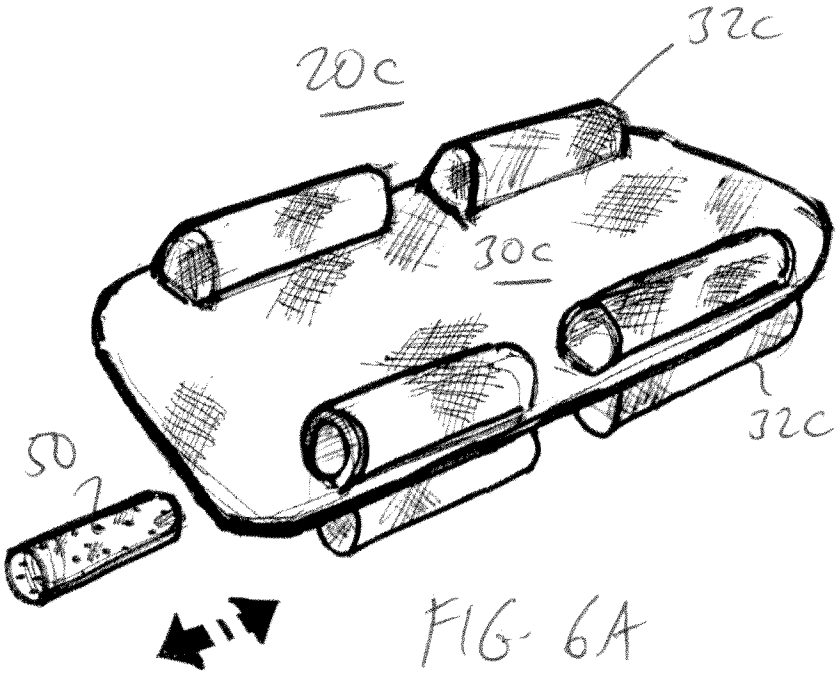
FIG. 6A is a perspective of a floating assembly according to a further embodiment of the present invention.

FIGS. 6A and 6B illustrate yet another floating assembly 20*c* according to the present invention. The assembly 20*c* is essentially the same as the assembly 20 of FIG. 1, so the same numeral designations will be used for both the assemblies 20 and 20*c*, except that a "c" is added to the designations in FIGS. 6A and 6B. The assembly 20*c* is essentially the same as the assembly 20 of FIG. 1, except that floatation sleeves 32*c* are stitched directly to the sheet material 30*b* on both surfaces of the sheet material 30*c*. In FIGS. 6A and 6B, eight floatation sleeves 32*c* are shown, with two provided along one upper edge of the sheet material 30*c*, two provided along the other upper edge of the sheet material 30*c*, two more provided along one lower edge of the sheet material 30*c*, and the last two provided along the other lower edge of the sheet material 30*c*.

FIGS. 7A and 7B illustrate a modification that can be made to the floating assembly 20 of FIG. 1. The sheet material 30 can be modified to provide a central cut-out region 31 which has a base section 33, a rear section 34 and two side sections 35. The rear section 34 and side sections 35 extend vertically or perpendicularly from the plane of the sheet material 30, and the base section 33 extends at an angle from sheet material 30 in a manner such that the side edges of the base section 33 are connected to the bottom edges of the rear section 34 and side sections 35. Thus, the rear section 34 is generally rectangular while the side sections 35 are generally triangular. The cut-out region 31 and its base section 33, rear section 34 and two side sections 35 define a seat for a user to sit on when the floating assembly 20 is deployed in water. See FIG. 7B. This allows the user to submerge part of his/her lower body into the water and enjoy a more comfortable seating position.

Figure 8:
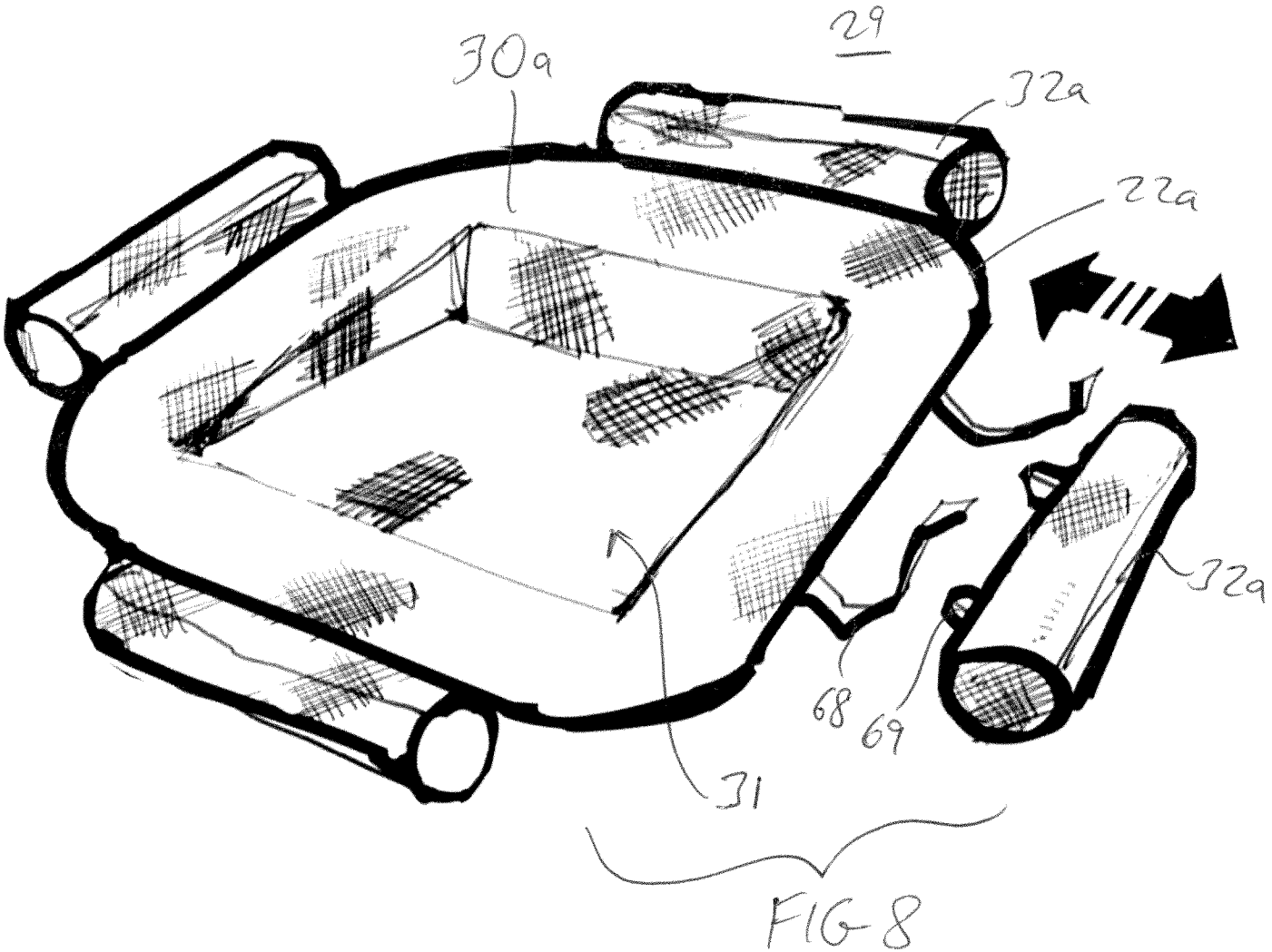
FIG. 8 is a perspective of a floating assembly according to yet another embodiment of the present invention.

FIG. 8 illustrates a floating assembly 29 that combines the concepts from FIGS. 4 and 7A, where the floatation sleeves 32*a* are attached to the peripheral edge 22*a*, and where a cut-out region 31 is provided in the sheet material 30*a*. FIG. 8 also illustrates another modification, where the floatation sleeves 32*a* are also removably attached to the peripheral edge 22*a*, such as by using tie members 68 and loops 69.

Figure 9:
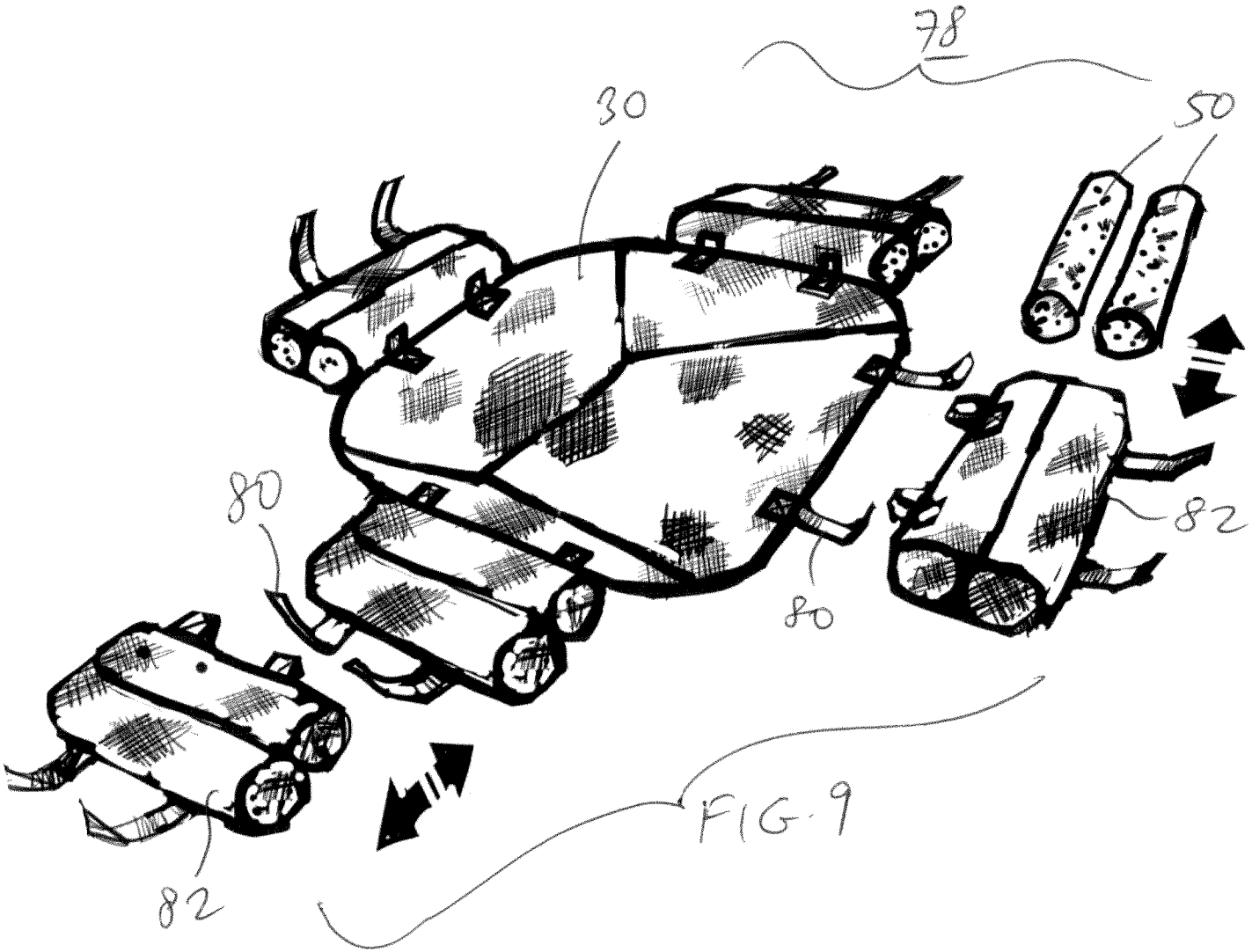
FIG. 9 is a perspective of a floating assembly according to a further embodiment of the present invention.

The principles of FIG. 8 can be further extended by the assembly 78 shown in FIG. 9. Here, the removable attachment of the floatation sleeves 82 can be accomplished by opposing Velcro™ straps 80. In addition, the floatation sleeves 82 can be sized and configured differently, such as to allow multiple foam pieces 50 to be fitted side-by-side therein. Additional floatation sleeves 82 can also be removably attached to existing floatation sleeves 82. Thus, the assembly 78 allows the user to add additional floating devices 50 to accommodate users with different weights, and to vary the floating characteristics of the assembly 78. For example, additional floating devices 50 can be deployed along one edge that can be used to support the user's back and head, and fewer floating devices 50 can be deployed along the opposite edge, so that the user can have his/her legs more submerged in the water and his/her back and head raised. Another flexibility provided by the assembly 78 is that different types of floatation sleeves 32 and 82 can be used along different edges, or even combinations of floatation sleeves 32 and 82 can be deployed. For example, the user could couple one floatation sleeve 32 with one floatation sleeve 82 to deploy three floatation devices 50 along one edge.

Figure 10:
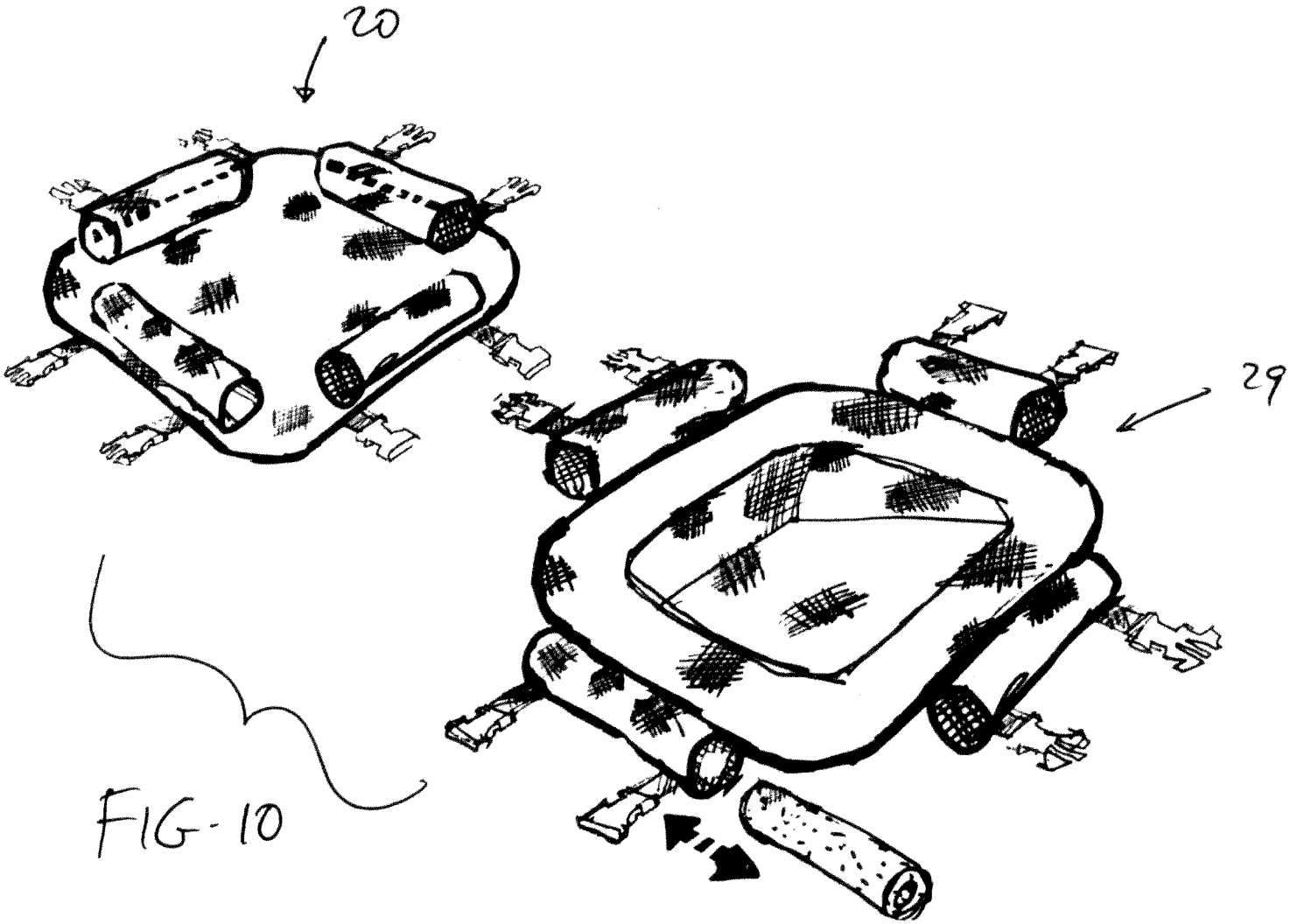
FIGS. 10 and 11 illustrate the connection or combination of two or more floating assemblies.
Figure 11:
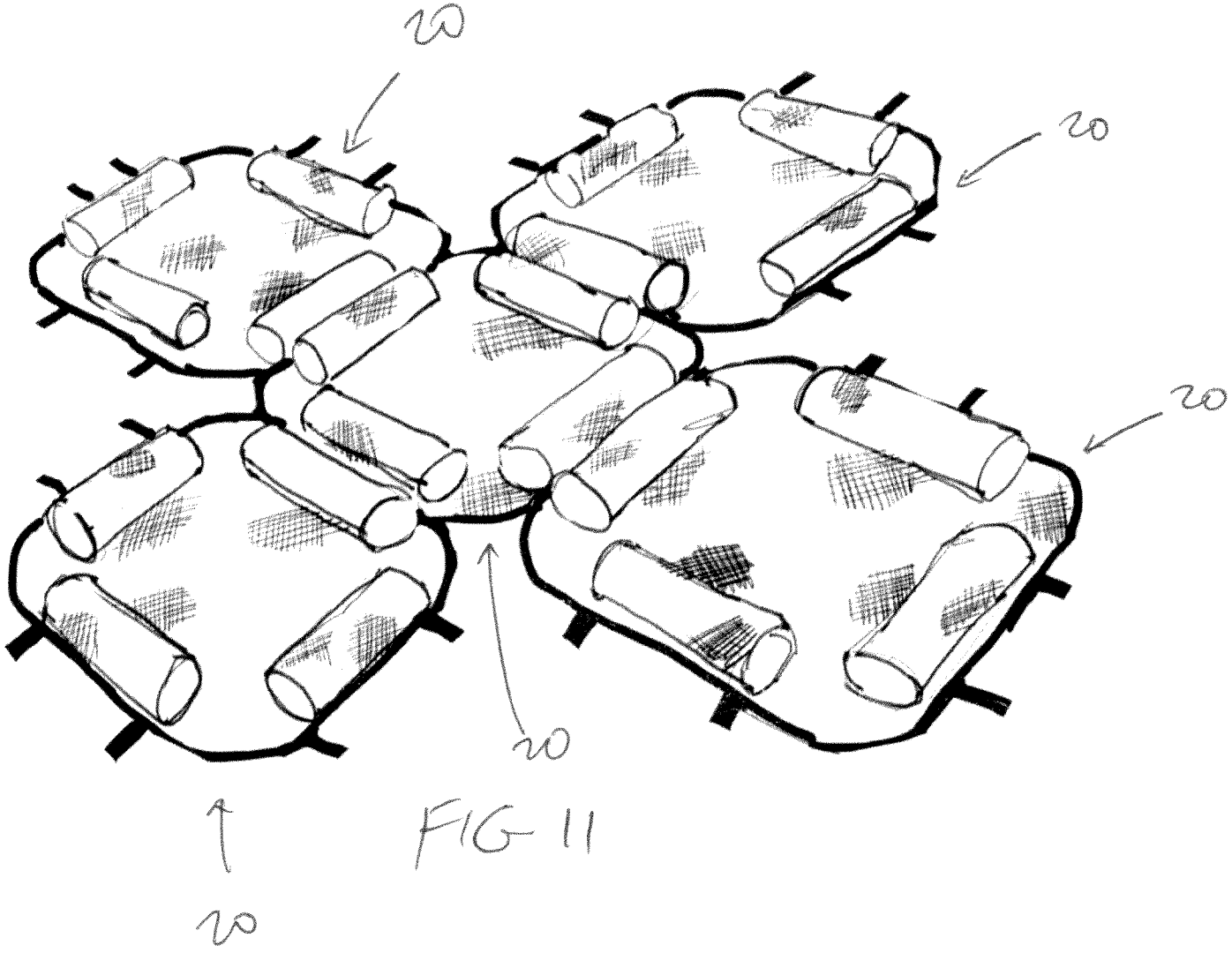
Figure 12:
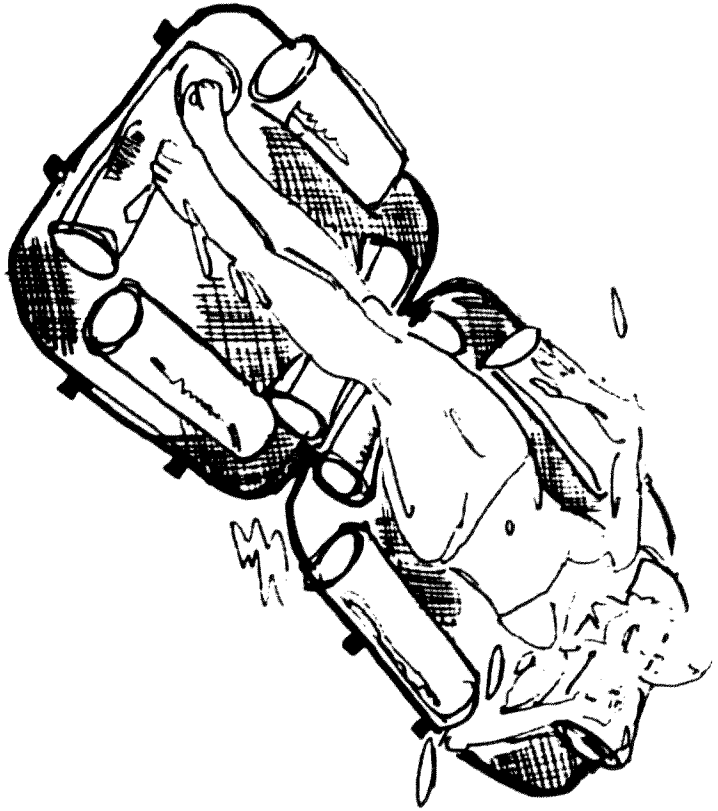
FIG. 12 illustrates a user lounging on two connected floating assemblies.

FIGS. 10-11 illustrate the removable attachment of different floating assemblies. As a non-limiting example, FIG. 10 illustrates the removable attachment of a floating assembly 20 with a floating assembly 29. As another non-limiting example, FIG. 11 illustrates the removable attachment of a plurality of floating assemblies 20. The removable attachment of the different floating assemblies allows the user to construct and configure a floating assembly of his or her choice, so as to create a floating assembly that suits the desired purpose. For example, FIG. 12 illustrates the removable attachment of two floating assemblies 20 to provide an elongated floating assembly that allows the user to lie flat. As another example, a similar elongated floating assembly with two floating assemblies 20 in FIG. 12 can be joined side-by-side with another two floating assemblies 20 to allow two users to lie side-by-side with each other on the resulting floating assembly.

Figure 13:
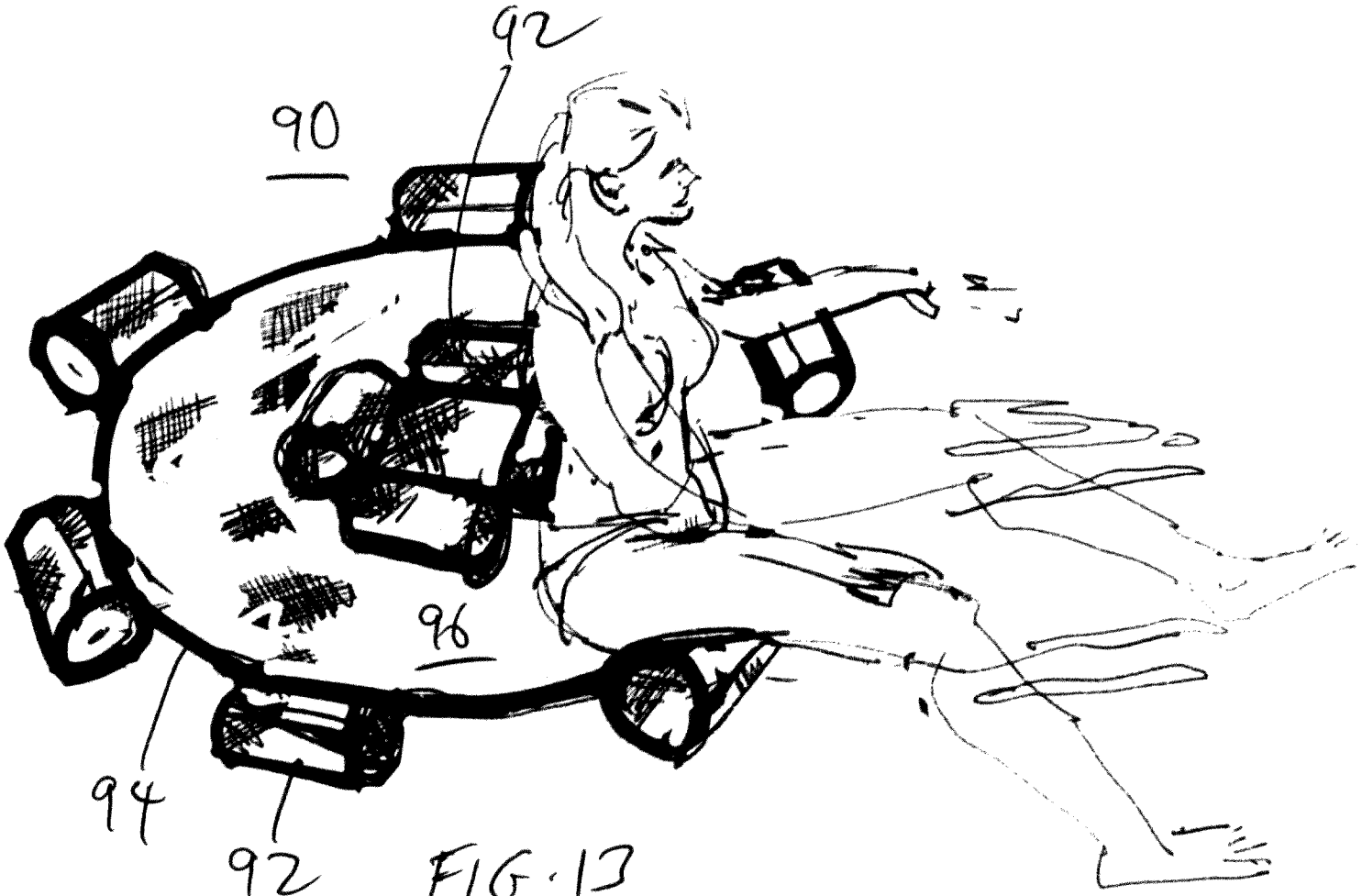
FIG. 13 is a perspective of a floating assembly according to yet a further embodiment of the present invention.

Finally, the floating assemblies according to the present invention do not need to be four-sided. FIG. 13 illustrates another floating assembly 90 that can have the same construction as the other floating assemblies described herein, except that the floating assembly 90 can be circular or oval. Floatation sleeves 92 can be provided in spaced-apart manner around the peripheral edge 94, and even on the upper surface of the sheet material 96 at the center thereof. The floatation devices inside the central floatation sleeves 92 can function as back rests. The floating assembly 90 in FIG. 13 can be configured to seat four individuals.

Thus, the present invention provides floating assemblies that can be easily and quickly deployed and packed up, and which allow the user to change the configurations and/or sizes to suit different needs.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A floating assembly for suspending a person on water, comprising:

a foldable frame member that has a folded and an unfolded orientation, the frame member defining a periphery for the assembly;

a sheet material covering portions of the frame member when the frame member is in the unfolded orientation, the sheet material defining a plane with a cut-out region, the cut-out region being spaced away from the frame member and having a base section, a rear section and two side sections, the base section having three side edges, and each rear section and side section having a bottom edge, with the rear section and side sections extending perpendicularly from the plane of the sheet material, and the base section extending at an angle from sheet material in a manner such that side edges of the base section are connected to bottom edges of the rear section and the side sections;

a plurality of floatation sleeves attached to the periphery; and a plurality of floatation devices that are removably inserted into each of the floatation sleeves.

2. The assembly of claim 1, further including a peripheral sleeve extending along the periphery for retaining the frame member.

3. The assembly of claim 1, wherein the frame member forms a plurality of concentric frame members when it has been twisted and folded into the folded orientation.

4. The assembly of claim 1, wherein the floating assembly is a first floating assembly, and further including a second floating assembly that comprises:

a second foldable frame member that has a folded and an unfolded orientation, the second frame member defining a second periphery for the second floating assembly;

a second sheet material covering portions of the second frame member when the second frame member is in the unfolded orientation;

a plurality of second floatation sleeves attached to the periphery; and a plurality of floatation devices that are removably inserted into each of the second floatation sleeves;

wherein one of the floatation sleeves of the first floating assembly is removably connected to one of the floatation sleeves of the second floating assembly.

5. The assembly of claim 1, wherein an independent floatation sleeve is removably coupled to at least one of the floatation sleeves; and a floatation device is removably inserted into the independent floatation sleeve.

6. The assembly of claim 1, wherein at least one of the floatation sleeves is sized and configured to receive only one the floatation devices, and the other of the flotation sleeves is sized and configured to receive at least two of the floatation of devices.

* * * * *